252-95 AU 157 EX
7/17/84 XR 4,460,487

United States Patent [19]
Robinson et al.

[11] Patent Number: 4,460,487
[45] Date of Patent: Jul. 17, 1984

[54] RINSE CYCLE FABRIC SOFTENER WITH BLEACH

[75] Inventors: Ronald A. Robinson, Garden Grove; Wendie T. Graf, Los Angeles; George D. Evans, III, Tustin, all of Calif.

[73] Assignee: Purex Corporation, Lakewood, Calif.

[21] Appl. No.: 371,981

[22] Filed: Apr. 26, 1982

[51] Int. Cl.[3] ..... D06M 13/46; D06L 3/02; C11D 7/54

[52] U.S. Cl. ..... 252/8.8; 252/95; 252/102

[58] Field of Search ..... 252/8.8, 95, 102

[56] References Cited

U.S. PATENT DOCUMENTS

| | | | |
|---|---|---|---|
| 3,689,424 | 9/1972 | Berg et al. | 252/110 |
| 3,749,674 | 7/1973 | Jones et al. | 252/95 |
| 3,844,959 | 10/1974 | Cracco et al. | 252/8.75 |
| 3,862,905 | 1/1975 | Eckert | 252/98 |
| 3,897,347 | 7/1975 | Eckert et al. | 252/8.75 |
| 3,962,100 | 6/1976 | Murphy et al. | 252/8.8 |
| 3,965,015 | 6/1976 | Bauman | 252/8.8 |
| 4,045,358 | 8/1977 | Ramachandran | 252/8.6 |
| 4,051,046 | 9/1977 | Diehl et al. | 252/8.6 |
| 4,166,794 | 9/1979 | Grey | 252/8.8 |
| 4,203,852 | 5/1980 | Johnson et al. | 252/8.8 |
| 4,273,661 | 6/1981 | Grey | 252/8.8 |

FOREIGN PATENT DOCUMENTS

| | | | |
|---|---|---|---|
| 55-7218 | 1/1980 | Japan | 252/102 |

OTHER PUBLICATIONS

Color Index, 3rd Ed., Soc. of Dyers and Colorists, 1971, p. 5645.

*Primary Examiner*—Maria Parrish Tungol
*Attorney, Agent, or Firm*—William W. Haefliger

[57] ABSTRACT

A stable, fabric bleaching and softening composition to be used in rinse water in contact with fabrics, and prior to fabric drying, consisting essentially of
(a) hydrogen peroxide,
(b) cationic amine softener, and
(c) water, wherein the weight ratio of softener to hydrogen peroxide is from about 1:20 to 2:3.

11 Claims, No Drawings

RINSE CYCLE FABRIC SOFTENER WITH BLEACH

BACKGROUND OF THE INVENTION

This invention relates generally to fabric bleaching and softening associated with washing and drying of such fabrics. More particularly, it concerns stable compositions of fabric softener and oxygen bleach, and method of employing same during fabric rinsing and drying.

While in the past the desirability of achieving bleaching and softening of fabrics was recognized, no way was known to combine effective bleaching with hydrogen peroxide and effective softening, wherein only one addition of the composition to the wash was required prior to drying, with the weight ratio of softener to bleach being kept relatively low.

SUMMARY OF THE INVENTION

It is a major object of the invention to provide compositions and methods capable of achieving the aforementioned effective bleaching and softening. Basically, the stable fabric bleaching and softening composition of the invention, to be used in rinse water in contact with fabrics, and prior to drying, consists essentially of (a) hydrogen peroxide, (b) cationic amine softener, and (e) water, wherein the weight ratio of softener to hydrogen peroxide is from about 1:20 to 2:3. As will appear, the hydrogen peroxide and softener together comprise between 7 and 10% by weight of the total composition.

Unusual advantages and combinations of advantages include: no decomposition of the hydrogen peroxide by the softener; mild bleaching action of the hydrogen peroxide, and safe use on all types of fabrics resulting in brightening of the washed fabric together with imparting of anti-static and lubricating qualities, with reduced wrinkling; only one addition of the composition to the wash (as during the rinse cycle) is required, as contrasted with separate additions of bleach during the wash cycle and softener during the drying cycle; and continuation of gentle bleaching during the time the fabric is in the clothes dryer.

DETAILED DESCRIPTION OF THE INVENTION

A typical formulation of the composition is as follows:

| | % range by weight | preferred |
|---|---|---|
| cationic amine, water dispersable softener (VARISOFT) 222, 90%, or equivalent | 2.3–2.7 | 2.4–2.6 |
| hydrogen peroxide (35%) | 5.9–6.2 | 6.0 |
| perfume | 0.1 | 0.1 |
| FASTOLUX Pigment Blue 15 | .001 | .001 |
| water, deionized | q.s. | q.s. |

The weight range of the combined softener and bleach is preferably between 7 to 20% of the total weight of the composition to be added to the wash, as during the rinse cycle. Thereafter, the aqueous rinse is completed, and the fabrics are tumbled in contact with hot air to effect drying thereof, producing the advantages referred to above.

The following table illustrates the good stability of the composition, with numbers indicating the percent loss of available oxygen, at room temperature.

| Test #1 | 34 days | 93 days | 402 days |
|---|---|---|---|
| Control (6% $H_2O_2$ in deionized water) | 0.3 | 4.2 | 14.3 |
| 6% $H_2O_2$ + 2.6% Varisoft 222 in DI water | 0 | 1.7 | 2.3 |
| **Test #2** | **14 days** | **76 days** | **385 days** |
| Control (6% $H_2O_2$ in DI water) | 0 | 1.5 | 5.0 |
| 6% $H_2O_2$ + 2.6% Varisoft 222 | 1.0 | 2.8 | 3.5 |

Stain removal capability of the composition is shown by the following test data, wherein numerals indicate percentage tea stain removal (the composition of the invention vs a control blank—i.e. absence of composition).

| % STAIN REMOVAL (Tea Stain) | | |
|---|---|---|
| | Rinse - 3 min. - 60° F. | |
| 15 min. Wash 120° F. | Blank | Softener V222/$H_2O_2$ Peroxide |
| 0.13% Purex Heavy Duty Dry | 4.8 | 16.5 |
| 0.15% Tide (6.1% P) | 9.8 | 14.6 |
| 0.10% Purex Heavy Duty Liquid | 3.5 | 6.4 |

Stain removal capability of the composition under varying conditions is shown by the following test data, wherein numerals indicate percentage stain (tea stain) removal (the composition of the invention vs a blank, and softener (V222) without bleach):

| % STAIN REMOVAL (Tea Stain) | | | | | |
|---|---|---|---|---|---|
| 120° F. Wash | 60° F. Rinse | Dry | Tide Blank | V222 $H_2O_2$ | V222 |
| ① 0.15% Tide | 15 min. | Dryer | 15.8 | 26.9 | 13.8 |
| ② | 3 min. | Dryer | 18.6 | 28.0 | |
| ③ | | Line Dry | 25.2 | 26.2 | |
| ④ | | | 19.0 | 21.2 | |
| ⑤ 0.10% Purex Heavy Duty Liquid | | | 8.7 | 11.9 | |

Softening effect, by feel test (votes) is indicated by the following test data:

| SOFTENING TEST (Total Votes) | | | |
|---|---|---|---|
| | Tide Blank | Softener/Bleach Blank | Softener |
| 1st cycle | 3 | 82* | 100** |
| 2nd cycle | 4 | 57* | 114** |

-continued

| SOFTENING TEST (Total Votes) | | | |
|---|---|---|---|
| | | Softener/Bleach | |
| | Tide Blank | Blank | Softener |
| 3rd cycle | 9 | 78* | 117** |

*received significantly more votes than the lowest value

**received significantly more votes than the two lowest values

Anti-static effectiveness of the composition is indicated by the following test data:

| ANTISTAT (% Static Removal) | | | | | | |
|---|---|---|---|---|---|---|
| | Tide Blank | | Softener/Bleach | | Softener | |
| | PDK | NT | PDK | NT | PDK | NT |
| 1st cycle | 0 | | 68 | 44 | 69 | 59 |
| | | | 56 | | 64 | |
| 2nd cycle | 0 | | 58 | 37 | 60 | 31 |
| | | | 48 | | 46 | |
| 3rd cycle | 0 | | 44 | 4 | 53 | 32 |
| | | | 24 | | 42 | |

In the above, PDK refers to polyester double knit, and NT refers to NYLON cloth.

In the above, the $H_2O_2$ used was Albone CG 35 (DuPont's 35% $H_2O_2$). Also usable is Super D 35% $H_2O_2$ a product of FMC Corporation. Both of these are "stabilized" grades of $H_2O_2$ that are sold for dilution to 3-6% $H_2O_2$. The "stabilizers" keep decomposition due to the metal catalyst to a minimum. A 50% $H_2O_2$ can also be used.

Usable fabric softeners are identified as follows:

A. Alkyldimethy ammonium quaternary compounds

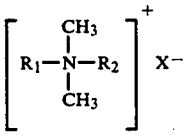

where $R_1$ and $R_2$ are fatty alkyls and $X^-$ is a halogen or methylsulfate ion B. Amido alkoxylated ammonium compounds

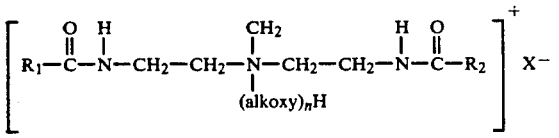

where $R_1$ and $R_2$ are fatty alkyls, the alkoxy is an ethylene or propylene oxide, and $X^-$ is a halogen, or most often methyl sulfate, ion.

C. Amido imidazolines

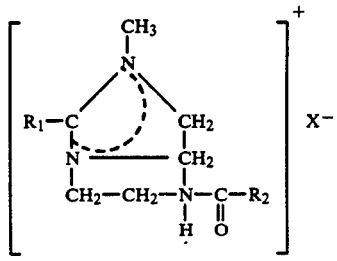

where $R_1$ and $R_2$ are fatty alkyls, and $X^-$ is a halogen or most often methyl sulfate, ion.

The above, other usable softeners are:

1. Alkyl ether diamine (Adogen 583 type)
2. Alkyl trimethyl ammonium chloride (Adogen 471 type)
3. Alkyl dimethylbenzyle ammonium chloride
4. Alkyl pyridinium chloride All of the above softeners are supplied as liquids (about 50%-90% cationic). The diluent is usually isopropyl alcohol. The higher active products are often a soft paste at normal temperatures but liquify at about 100°-120° F.

Further, the levels of $H_2O_2$ disclosed herein are substantially above those used, for example, in U.S. Pat. No. 4,166,794. Thus, about twice as much $H_2O_2$ on a weight percent basis, as is used in U.S. Pat. No. 4,166,794 is desirable. Further, from the teaching of the latter patent, the use of a weight percentage of $H_2O_2$ in excess of the weight percentage of softener was there considered disadvantageous as respects softening and bleaching; whereas applicant herein has found that the larger weight percentages, as disclosed, of $H_2O_2$ as compared with softener enables use of a product which, when added to rinse cycle, gives desired softening and bleaching during that cycle, and also gives extra bleaching in the dryer cycle.

The softener-bleach formulas described in U.S. Pat. No. 4,166,794 would be difficult to successfully employ in a commercial product because of the use of relatively high levels of cationic, which causes gel formation. In that patent, isopropyl alcohol is required to reduce the gel. The patent also speaks of adding NaCl as a thinning agent, but this would produce $H_2O_2$ instability because $Cl^-$ is a catalyst for $H_2O_2$ decomposition. The invention herein does not have this problem because of the use of lower levels of softener. In addition it is found that higher levels of $H_2O_2$ help reduce viscosity.

The following are examples of usable formulations:

1. 5:7.5 wt. ratio of amido imidozoline to hydrogen peroxide

| Ingredient | % wt. |
|---|---|
| Varisoft 475 (100% Act. basis) | 6.0 |
| Albone CG 35% (100% $H_2O_2$ basis) | 9.0 |
| perfume (perfume) | 0.1 |
| Graphtol Blue 6825-2-020, as is | 0.005 |
| Deionized water | q.s. |

2. 5:75 wt. ratio of alkyldimethyl ammonium quaternary compound to hydrogen peroxide

| Ingredient | % wt. |
|---|---|
| Varisoft 137 (100% Act. basis) | 6.0 |

-continued

| Ingredient | % wt. |
|---|---|
| Super D, 35% (100% $H_2O_2$ basis) | 9.0 |
| Igepal CO-630 | 1.0 |
| perfume | 0.1 |
| Graphtol Blue 6825-2-020, as is | 0.005 |
| Deionized water | q.s. |

3. 5:75 wt. ratio of amido alkoxylated ammonium quaternary compound to $H_2O_2$

| Ingredient | % wt. |
|---|---|
| Varisoft 222 (100% Act. basis) | 6.0 |
| Super D, 35% (100% $H_2O_2$ basis) | 9.0 |
| perfume | 0.1 |
| Graphtol Blue 6825-2-020, as is | 0.005 |
| Deionized water | q.s. |

4. 5:100 wt ratio of amido alkoxylated ammonium quaternary compound to $H_2O_2$

| Ingredient | % wt |
|---|---|
| Varisoft 222 (100% Act. basis) | 0.5 |
| Igepal CO-630 | 1.0 |
| Super D, 35% (100% $H_2O_2$ basis) | 10.0 |
| perfume | 0.1 |
| Graphtol Blue 6825-2-020, as is | 0.005 |
| Deionized water | q.s. |

All of the above examples were carried out for stability testing at room temperature and 140° F.

After one month of storage, all samples showed excellent stability. None of the examples lost more than 1% available oxygen at room temperatures, while at 140° F. none lost more than 7% available oxygen when compared to the initial available oxygen.

In the above, Graphtol Blue and Peacock Blue are both the same type pigment, i.e. Pigment Blue 15 (Color Index name). The composition is given in American Association of Textile Chemists and Colorists (AATCC) Color Index. It is a copper phthalocyanine.

We claim:

1. A stable, fabric bleaching and softening composition to be used in rinse water in contact with fabrics, and prior to fabric drying, consisting essentially of (a) hydrogen peroxide, (b) cationic amine softener, and (c) water, wherein the weight ratio of softener to hydrogen peroxide is from about 1:20 to 2:3.

2. The composition of claim 1 wherein said weight ratio is from 2.3/6.0 to 2.7/6.0.

3. The composition of claim 1 wherein said softener consists of an amido alkoxylated ammonium compound, 90%, or equivalent.

4. The composition of claim 1 wherein said hydrogen peroxide and softener together comprise less than 20% of the percentage weight of the total composition.

5. The composition of claim 1 having the following weight percentages:

| | % wt. |
|---|---|
| hydrogen peroxide | about 6.0 |
| softener | from 2.4 to 2.6 |
| [PF - 937] perfume | 0.0 |
| FASTOLUX [Peacock] | 0.001 |
| Pigment Blue 15 | |
| Water, deionized | q.s. |

6. The composition of one of claims 1–5 wherein the hydrogen peroxide aqueous concentration is about 35%.

7. The method of achieving both gentle bleaching and fabric softening of fabrics during rinsing and drying that includes (a) rinsing the fabrics with water containing a stable, fabric bleaching and softening composition consisting essentially of hydrogen peroxide and a cationic amine softener, wherein the weight ratio of softener to hydrogen peroxide is from about 1:20 to 2:3, (b) completing the rinse, and (c) tumbling the fabrics in contact with hot air to effect drying thereof.

8. The method of claim 7 wherein said weight ratio is from 2.3/6.0 to 2.7/6.0.

9. The method of claim 7 wherein said softener consists of an amido alkoxylated ammonium compound, 90%, or equivalent.

10. The method of one of claims 1–9 wherein the hydrogen peroxide concentration is about 35%.

11. The composition of claim 1 wherein the softener is selected from the group that consists of alkyldimethy ammonium quaternary compounds, amido alkoxylated ammonium compounds, amido imidazolines, alkyl ether diamine, alkyl trimethyl ammonium chloride, alkyl dimethylbenzyl ammonium chloride, and alkyl pyridimium chloride.

* * * * *